United States Patent [19]

Hounsel et al.

[11] 4,449,345

[45] May 22, 1984

[54] INSULATION MODULE HARDWARE

[75] Inventors: Mack A. Hounsel; Carlisle O. Byrd, Jr., both of Houston, Tex.

[73] Assignee: Manville Service Corporation, Denver, Colo.

[21] Appl. No.: 490,012

[22] Filed: Apr. 29, 1983

Related U.S. Application Data

[62] Division of Ser. No. 245,946, Mar. 20, 1981, Pat. No. 4,381,634.

[51] Int. Cl.[3] ..... E04B 1/80

[52] U.S. Cl. ..... 52/506; 52/404; 52/509; 110/336

[58] Field of Search ..... 52/506, 404, 410, 509, 52/796, 797, 408, 511; 428/184, 176, 121; 110/331, 336, 338

[56] References Cited

U.S. PATENT DOCUMENTS

| | | | |
|---|---|---|---|
| 3,832,815 | 9/1974 | Balaz et al. | 52/509 X |
| 3,854,262 | 12/1974 | Brady | 52/506 X |
| 4,233,468 | 11/1980 | Northup | 52/506 |
| 4,287,839 | 9/1981 | Severin | 52/506 X |
| 4,339,902 | 7/1982 | Cimochowski et al. | 52/509 X |
| 4,381,634 | 5/1983 | Hounsel et al. | 52/509 |

FOREIGN PATENT DOCUMENTS

| | | |
|---|---|---|
| EP 18677 | 11/1980 | European Pat. Off. . |
| 2393254 | 12/1978 | France . |
| 2004626 | 4/1979 | United Kingdom . |

*Primary Examiner*—J. Karl Bell

*Attorney, Agent, or Firm*—Richard K. Thomson

[57] ABSTRACT

Refractory ceramic fiber blanket modules with a continuous strip of ceramic fiber material folded into a number of layers in a serpentine fashion are used to insulate high temperature equipment. The blanket is supported by support structure which penetrates the blanket in the vicinity of folds near the furnace wall, providing increased strength against tearing away of the blanket from the supports.

10 Claims, 6 Drawing Figures

52
14
32
28
S
16
52
20
12
22
M
14
10
B
12
16
18
50
46
48
44
44
32
36
38
34
40
40
34
S
42
38
42
52
30
28
26
26
24
22
24
52

INSULATION MODULE HARDWARE

This is a divisional application of U.S. patent application Ser. No. 245,946, filed Mar. 20, 1981, now U.S. Pat. No. 4,381,634.

FIELD OF THE INVENTION

The present invention relates to modular refractory ceramic fiber blanket insulation systems.

DESCRIPTION OF PRIOR ART

U.S. Pat. Nos. 3,952,470 and 4,001,996 each relate to modular refractory ceramic fiber blocks formed from folded ceramic fiber blankets for insulating furnaces and the like. In these modules, supporting rods were mounted within and extended along certain of the folds in the blankets. Other U.S. patents relating to insulation modules of which one of applicants is inventor are U.S. Pat. Nos. 4,055,926; 4,086,737; 4,103,469; and 4,122,386.

Another type of modules, such as in U.S. Pat. Nos. 3,819,468 and 3,832,815 has utilized wires or pins extending transversely through a number of aligned strips of "edge grain" ceramic fiber material to hold the strips together in the module. However, the purpose of these wires or pins was not apparently for support of the modules when installed, since other support mechanisms were provided for the modules.

Another type of furnace insulation impaled the insulative blanket onto spears or hangers generally parallel to the furnace walls. These spears had to be installed prior to the blanket being attached, causing a more complicated installation. Examples of this type of insulation are U.S. Pat. No. 3,892,396 and the type sold as "Nip & Tuck" modules by C-E Refractories, Combustion Engineering, Inc. of Valley Forge, Pa.

SUMMARY OF INVENTION

Briefly, the present invention comprises a new and improved ceramic fiber blanket module for insulating an inner surface, such as a wall or roof or the like, in a furnace or other type of heating or heat-treating equipment. The module is formed from plural folds of adjacent layers of refractory ceramic fiber insulating material which are supported on the inner wall of the furnace.

The folded insulating blanket is preferably formed from a continuous strip of ceramic fiber material folded into a number of layers in a serpentine or undulating form. The folded blanket has an inner surface portion to be exposed along an insulation surface to interior conditions in the furnace and an outer surface portion adapted to be mounted against a wall of the furnace. Side portions of adjacent layers extend generally perpendicularly to the furnace wall and parallel to each other and are folded into U-shaped folds at inner and outer ends adjacent the inner and outer surfaces to form alternating inner and outer folds.

The folded insulating blanket is supported on the furnace inner surface by supports which extend through plural side portions of the blanket adjacent the outer folds. Suspension members are mounted on the outer surface of the blanket adjacent layers to receive the supports. The suspension members are attached by attachment structure to the inner surface of the furnace. With the supports extending through the side portions of blanket and mounted adjacent the outer folds, improved strength and resistance to tearing or pull-away of the blanket from the supports has been found to be achieved with the present invention.

DESCRIPTION OF THE PREFERRED EMBODIMENTS

Figures 1, 2:
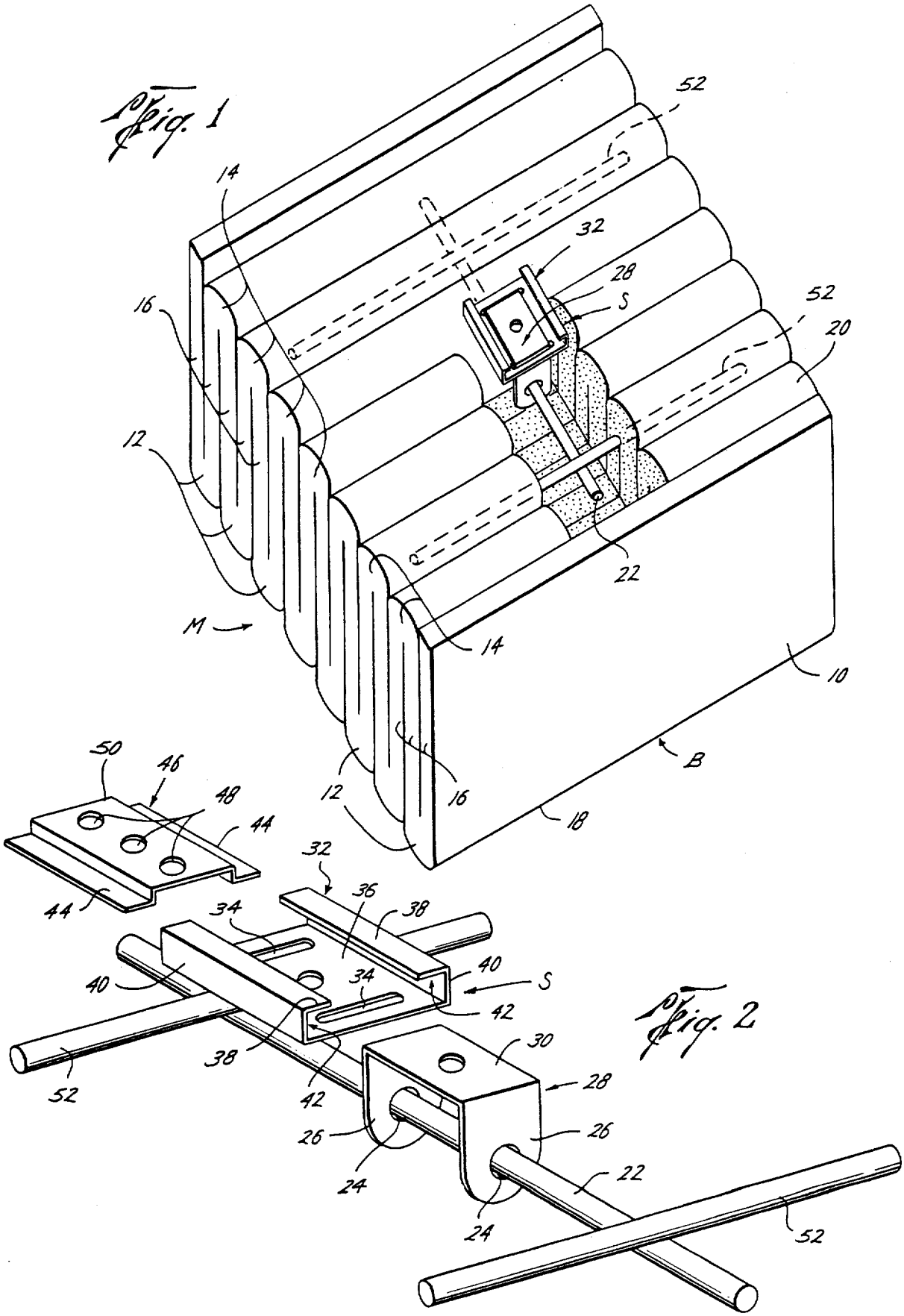
FIG. 1 is an isometric view, taken partly in cross-section, of an insulation module according to the present invention.
FIG. 2 is an exploded isometric view of supporting structure for the module of FIG. 1.

In the drawings, the letter M (FIG. 1) designates generally a refractory ceramic fiber blanket module or block for mounting with an inner surface, such as a wall or roof, of a furnace or other heating, heat treating or high temperature equipment. For this reason, furnace and high temperature equipment will be used interchangeably in this description. The module M is preformed from a folded insulating blanket B and is supported on the inner surface by support structure S (FIGS. 1 and 2).

The blanket B may by any of several commercially available high temperature refractory ceramic fiber blanket materials, such as those containing aluminum-silica fibers as disclosed in U.S. Pat. Nos. 3,952,470 and 4,001,996. The blanket B is preferably in the form of a continuous strip 10 of the ceramic fiber blanket material folded into alternate U-shaped inner folds 12 and outer folds 14 interconnected with each other by parallel side portions 16. The side portion 16 extends between an inner surface 18 adjacent the inner folds 12 and an outer surface 20 adjacent the outer folds 14. The inner surface 18, commonly referred to in the art as a "hot face", is exposed to internal conditions in the high temperature equipment being insulated, while the outer surface 20 is adapted to be mounted against the inner surface of the equipment by the supports S.

In the support S (FIGS. 1 and 2), a support means 22 in the form of a rod or bar extends through a plurality of side portions 16 of the blanket B adjacent the outer folds 14 to support the blanket in place when the module M is installed. The blanket B, on installation, is normally in a state of compression, and thus because of this and the frictional engagement between the fibers of the blanket and the rod 22, the rod 22 need not extend completely through the entire blanket B. It should be understood that rod 22 may, however, extend completely through the blanket B, if desired. Rod 22 is shown in the preferred embodiment as a solid rod of suitable material, such as a stainless steel of suitable temperature characteristics based on temperature conditions in the equipment. It should be understood, however, that other shaped members may serve as a support means. For example, a hollow tubular member, a bar or rod of generally rectangular cross-section or other suitable shape of elongate member may be used as a support means with the present invention.

The support rod 22 extends through openings 24 in suspension tabs 26 of a suspension arm 28 of the support S. The suspension tabs 26 are interconnected by a connector member 30 and are adapted to be inserted adjacent outer folds 14 at spaced positions from each other on the blanket B, with the length of the connector member 30 determining the amount of such spacing.

The suspension arm 28 is connected with a slide channel member 32 by insertion of suspension tabs 26 through elongate slots 34 formed in a center plate portion 36 of slide channel 32. The slide channel 32 further has mounting rails 38 spaced from the plate member 36 by connecting arms 40 to form receiving slots 42. The receiving slots 42 receive depressed side arms or rails 44 of an attachment member 46. The attachment member 46 has one or more openings 48 formed in an upper portion 50 therein so that the member 46 may be stud welded or otherwise attached to the inner surface of the equipment being insulated. Although shown in the drawing as a member of generally rectangular shape, the attachment member 46 could also be formed in other shapes, such as in the form of a washer with a depressed outer rim to fit within receiving slots 42 of the slide channel 32.

If desired, or if required in particular situations, the support S may also include a suitable number, depending upon support requirements, of fold support rods 52, each mounted in a different fold 16 between the support rod 22 and the material of the blanket B adjacent the inner surface of the furnace. However, it should be understood that rods 52 need not be used in some situations, with the single rod 22 securing each fold of the blanket B and providing adequate support.

Figure 3:
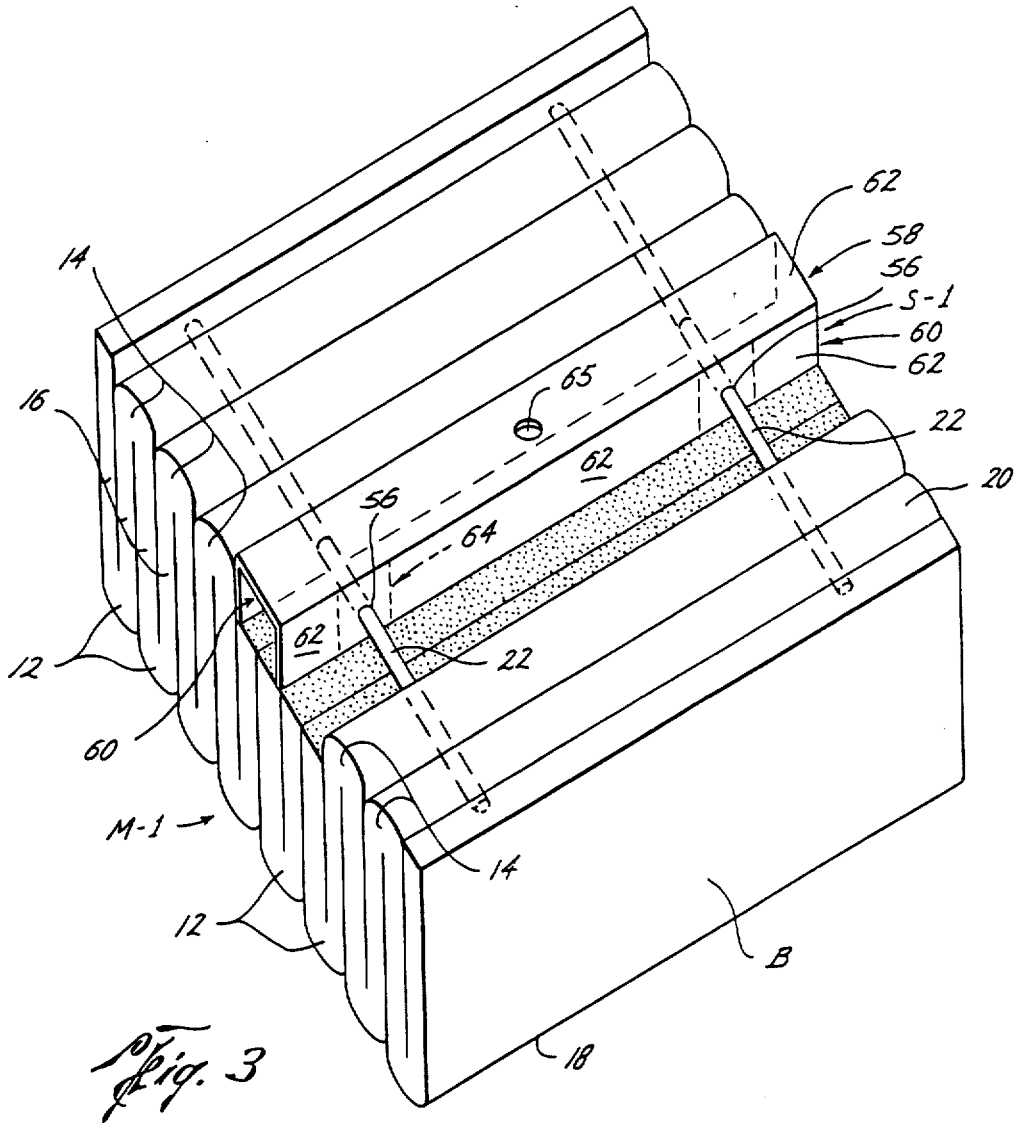
FIG. 3 is an isometric view, taken partly in cross-section of another insulation module according to the present invention.
Figure 4:
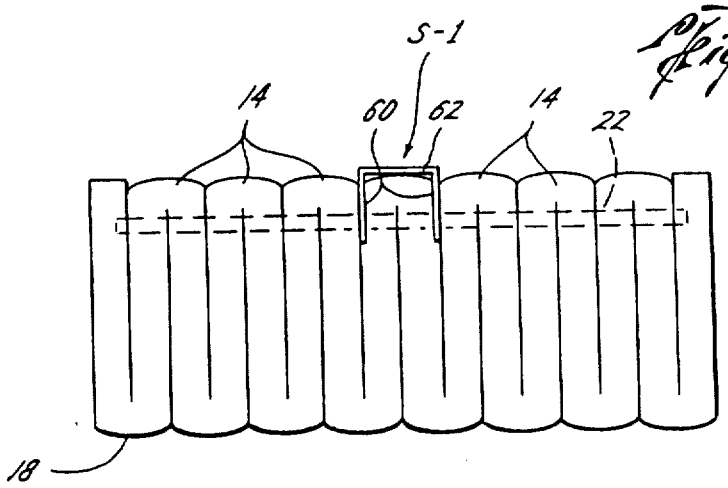
FIG. 4 is a side elevation view of the module of FIG. 3.

In a module M-1 (FIGS. 3 & 4) of the present invention, the blanket B is formed in a like manner to the blanket of the module M. In module M-1, the blanket B is supported by a support S-1.

The support S-1 includes a plurality of suspension rods which are like rod 22 of FIG. 1 and thus bear the same reference numeral. Rod 22 extends through a plurality of the side portion 16 of the blanket B adjacent the outer folds 14 to support the blanket B in place in the furnace when installed. The support rods 22 are mounted at spaced positions from each other, preferably at a common distance from the outer surface portion 20 of the blanket B. Further, the support rods 22 are preferably mounted substantially parallel to each other in a common plane in the blanket B.

Each of the support rods 22 is received in a suitable opening 56 in a suspension arm 58. The suspension arm 58 may be in the form of a pair of unitary suspension tabs 60, having a plurality of openings 56 formed therein for receiving the plural support rods 22, and connected by a connector member 62 which extends across the inner surface 20 of the blanket B substantially equally with the width of the folded blanket B.

Alternatively, portions of the suspension tabs 60 can be removed at area 62 not proximate to the openings 56, as indicated by phantom lines 64, leaving a plurality of individual suspension tab located in pairs at various positions across the width of the connection member 62, with each such suspension tab pair receiving one of the support rods 22. The suspension arm 58 has an opening 65 formed at a suitable location in the connector member 62 through which a bolt or other mounting device may be passed to attach the module M to the furnace wall.

Figure 5:
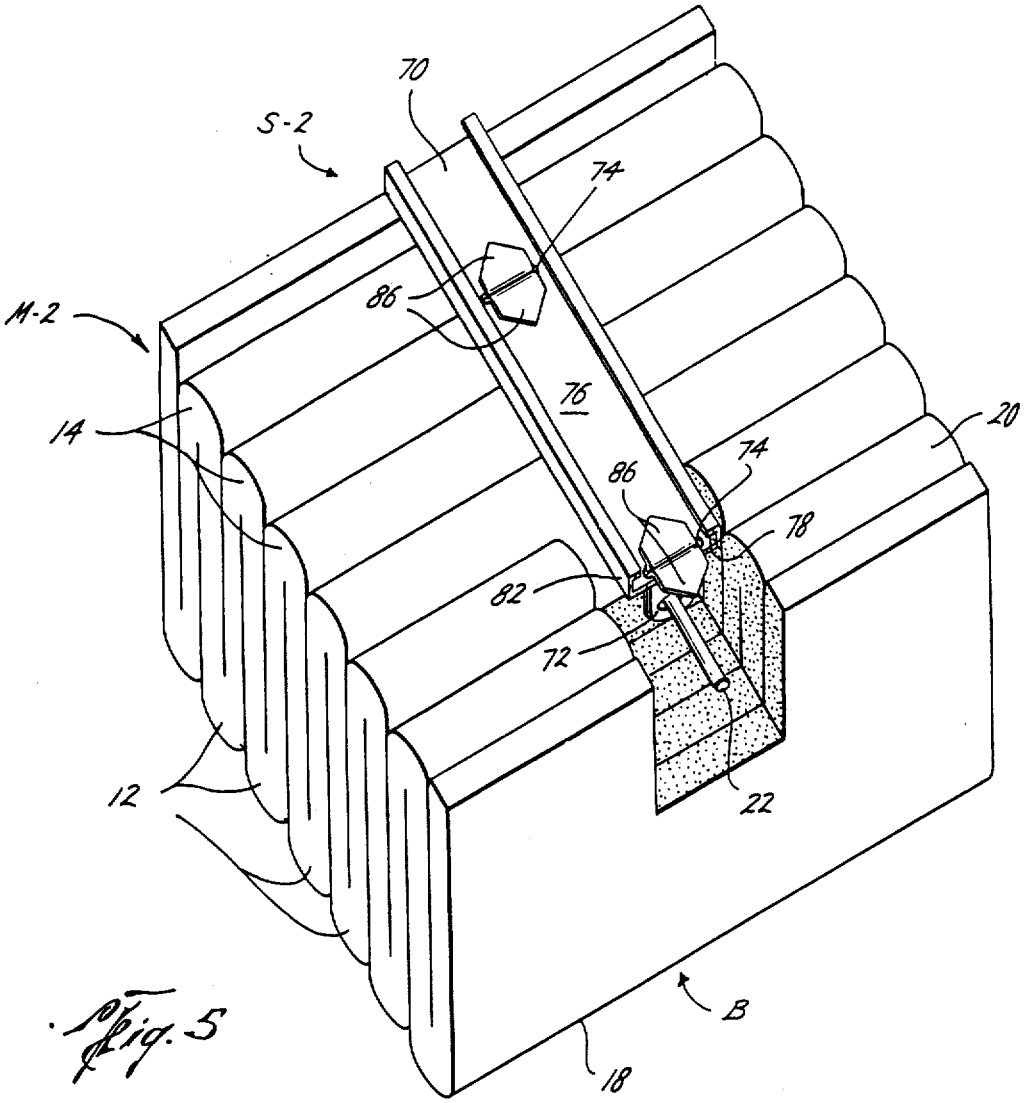
FIG. 5 is an isometric view, taken partly in cross-section, of another insulation module according to the present invention.
Figure 6:
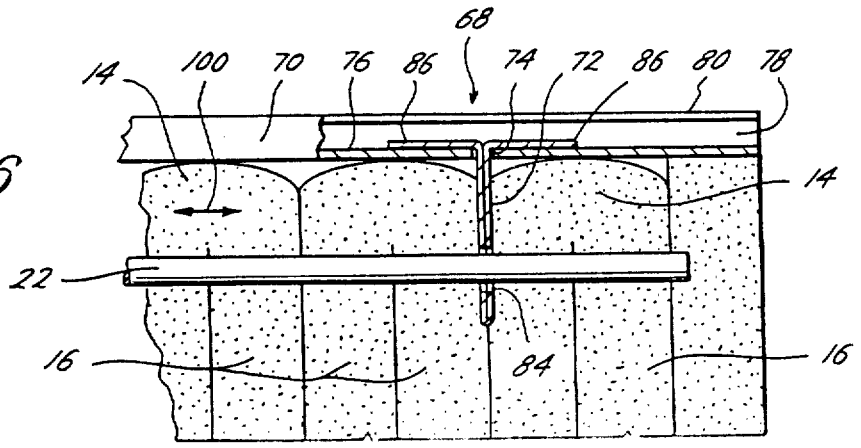
FIG. 6 is a side elevation view, taken partly in cross-section of a portion of the module of FIG. 5.

In a module M-2 (FIGS. 5 & 6) of the present invention, the blanket B is formed in a like manner to the module M and is supported by a support S-2. The support S-2 includes a support rod 22 extending through a plurality of side portions 16 of the blanket B adjacent the outer folds 14 to support the blanket B in place.

The support S-2 is mounted with the blanket B by a suspension arm 68 in the form of an elongate slide channel member 70 having two or more suspension tabs 72 mounted at spaced positions to extend into the blanket B between adjacent outer folds 14 at locations established by slots or openings 74 in a central portion 76 of the slide channel 70.

The slide channel 70 further has a receiving slot 78 formed by mounting rails 80 and connector members 82 for receipt of an attachment member, such as of the type shown in FIG. 2 of the drawings and discussed hereinabove.

The suspension tabs 72 have openings 84 formed for passage of the support rod 22, which extends through the blanket B in a like manner to the modules M and M-1. The suspension tab 72 is preferably formed by bending a strip of suitable metal material, such as stainless steel, to form an inwardly extending portion where the openings 84 may be formed. Further, the support tab 72 has two outer mounting lugs 86 which are bent flat against the central portion 76 of the slide channel 70 once the suspension tabs 72 are properly positioned. The lugs 86 may be spot welded to the slide channel 70, if desired.

It should be understood that the particular structure shown in each of the embodiments of the present invention may be used with the modules of other embodiments. For example, a plurality of support rods 22, each attached with a support S (FIG. 1) may be mounted within the blanket B so that the module M would have a plurality of support rods 22 mounted by support S at spaced positions from each other in the manner of module M-1. Likewise, support rods 22, each with a support S-2 (FIG. 5) may be mounted with the blanket B so that the module M-2 has a plurality of support rods 22 mounted by support S-2 at spaced positions from each other as in the manner of module M-1.

Further, fold support rods 52 of the module M could also be mounted in folds of the blanket B in either of the modules M-1 and M-2 and supported by support rods 22 therein.

The modules of the present invention are formed by folding the blanket B into the configuration shown in the drawings. Suspension arms are then mounted with the outer surface portion 20 so that the suspension tabs extend between adjacent outer folds 14 at the requisite locations within the blanket B. A guide plate or other suitable positioning structure is then brought into proximity with the outermost side portion 16 of the blanket B and the support rods 22 are forced through the side portions 16 of the blanket B and through the openings formed in the suspension tabs of the particular suspension arm being used. If desired, a needle or other piercing device may be mounted ahead of the support rod 22 to facilitate passage of such rod 22 through the blanket B. Once the support rods 22 are properly positioned within the blanket B, the modules of the present invention may be wrapped with a suitable wrapping material to maintain them under compression prior to installation. The modules of the present invention could then be mounted to inner surfaces of the equipment being insulated in any of the several ways set forth in U.S. Pat. Nos. 3,952,470 and 4,001,996.

With the modules of the present invention having the support rods 22 penetrating the side portions 16 of the blanket B in the vicinity of the outer folds 14, preferably substantially at the base of the folds 14, applicants have found that the blankets B being penetrated will hold significantly longer and at significantly greater weight loads against tearing than blankets of the edge grain type. Tearing is a phenomenon which occurs in modular ceramic refractory fiber blankets, since the fibers of such blankets are generally deposited in planes along the length of blanket B. Thus, with edge-grain fiber blanket modules, the strips of such modules are mounted in the modules so that when the rod passes through these strips transversely through the plane in which the fibers in the blanket have their greatest strength against tearing. Conversely, with the present invention, the upper fold 14 provides a mass of fiber blanket material having the fibers running in a plane, indicated generally by an arrow 100 (FIG. 6), where the fibers exhibit their greatest strength against tearing. Thus, applicants have found that the modules of the present invention exhibit increased strength against tearing forces which might tend to cause the blanket B to fall from the wall of the furnace in use.

Further, only the folds of the blanket B between the suspension members restrict the folds of the blanket moving along the support rod 22. The compression in the unrestricted folds of the blanket B is available for use in forming a tight joint with modules, since the unrestricted folds may move along the rods 22.

The foregoing disclosure and description of the invention are illustrative and explanatory thereof and various changes in the size, shape and materials as well as in the details of the preferred embodiment may be made without departing from the spirit of the invention.

We claim:

1. Attachment hardware adapted for mounting an insulation module on one surface of a furnace, said module having a hot face and a cold face which between them define a module thickness, a pair of side faces which between them define a module length, and a top face and a bottom face which between them define a module width, said hardware comprising:

suspension arm means extending along some portion of the length and width of the cold face of the module, said suspension arm means having a plurality of suspension tabs extending from the cold face toward the hot face for some predetermined distance into the thickness of said module intermediate said two side faces;

at least one set of aligned apertures in said suspension tabs;

support bar means extending longitudinally through at least some portion of the length of the module, said support bar means being received in said at least one set of aligned apertures in the plurality of suspension tabs and penetrating said module, said portion of the length of the module being less than the full length whereby said suspension tabs and said support bar means are fully contained internally of said module; and means for securing said suspension arm means to said furnace wall.

2. The attachment hardware of claim 1 wherein said suspension arm means and said suspension tabs comprise a generally C-shaped channel member.

3. The attachment hardware of claim 2 wherein said support bar means comprise two support rods which are received in two pairs of aligned apertures in said support tabs.

4. The attachment hardware of claim 1 further comprising two support rods extending generally perpendicular to said support bar means.

5. The attachment hardware of claim 1 wherein said means for securing the suspension arm means to said furnace wall includes an attachment member with depressed side rails which is attached to said furnace wall as by welding.

6. The attachment hardware of claim 5 wherein said securing means further comprises a slide channel attached to said suspension arm means.

7. The attachment hardware of claim 6 wherein said slide channel means engages said depressed rails of the attachment member for securing said module to the furnace wall.

8. The attachment hardware of claim 6 wherein said slide channel has a plurality of slots which receive said suspension tabs to effect the attachment of the slide channel to said suspension arm means.

9. The attachment hardware of claim 1 wherein said suspension tabs are separate members which are affixed to the suspension arm means.

10. The attachment hardware of claim 1 wherein the portion of the length through which the support bar means extends is less than the length of said module.

* * * * *

UNITED STATES PATENT AND TRADEMARK OFFICE

CERTIFICATE OF CORRECTION

PATENT NO. : B1 4,449,345

DATED : March 12, 1991

INVENTOR(S) : Mack A. Hounsel, Carlisle O. Byrd

It is certified that error appears in the above-identified patent and that said Letters Patent is hereby corrected as shown below:

Column 1:

Claim 1, Line 4, Delete "said" and insert --side--;

Column 2:

Claim 12, Line 3, Delete "arms" and insert --arm--;

Claim 17, Line 3, Delete "arms" and insert --arm--;

Claim 18, Line 5, Delete "point attachment" and insert --attachment point--.

Signed and Sealed this

Tenth Day of October, 1995

Bruce Lehman

*Attest:*

BRUCE LEHMAN

*Attesting Officer*

*Commissioner of Patents and Trademarks*

REEXAMINATION CERTIFICATE (1427th)

United States Patent [19]

Hounsel et al.

[11] B1 4,449,345

[45] Certificate Issued Mar. 12, 1991

[54] INSULATION MODULE HARDWARE

[75] Inventors: Mack A. Hounsel; Carlisle O. Byrd, Jr., both of Houston, Tex.

[73] Assignee: Manville Sales Corp., Denver, Colo.

Reexamination Request:
No. 90/001,835, Aug. 31, 1989

Reexamination Certificate for:

| | |
|---|---|
| Patent No.: | **4,449,345** |
| Issued: | **May 22, 1984** |
| Appl. No.: | **490,012** |
| Filed: | **Apr. 29, 1983** |

Related U.S. Application Data

[62] Division of Ser. No. 245,946, Mar. 20, 1981, Pat. No. 4,381,634.

[51] Int. Cl.[5] ..... E04C 1/80

[52] U.S. Cl. ..... 52/506; 52/404; 52/509; 110/336

[58] Field of Search ..... 52/506, 508, 509, 404, 52/410, 796, 797, 511; 428/184, 176, 121; 110/331-338

[56] References Cited

U.S. PATENT DOCUMENTS

| | | | |
|---|---|---|---|
| 3,819,468 | 6/1974 | Sauder et al. . | |
| 3,832,815 | 9/1974 | Balaz et al. | 52/509 X |
| 3,854,262 | 12/1974 | Brady | 52/506 X |
| 3,892,396 | 7/1975 | Monaghan . | |
| 3,952,470 | 4/1976 | Byrd, Jr. . | |
| 4,001,996 | 1/1977 | Byrd, Jr. . | |
| 4,055,926 | 11/1977 | Byrd, Jr. . | |
| 4,086,737 | 5/1978 | Byrd, Jr. . | |
| 4,103,469 | 8/1978 | Byrd, Jr. . | |
| 4,123,886 | 11/1978 | Byrd, Jr. . | |
| 4,339,902 | 7/1982 | Cimochowski et al. | 52/509 |

FOREIGN PATENT DOCUMENTS 2006413A 10/1978 United Kingdom .

OTHER PUBLICATIONS

Sauder Industries, Inc.; Pyro-Bloc; 06/00/74; 4 pages.
StudWeldPro-UK, Ltd.; Convo-Section Fibre Linings; 01/00/77; 2 pages.
C. E. Refractories; Nip & Tuck Modular Fiber Construction; 08/30/79; 2 pages.
A. P. Green Refractories Co.; Inswool Modules-The New Ceramic Fiber Modular Concept; 01/27-29/81; 4 pages.
Carborundum Co.; Installation Procedures for Stackboard Systems; 04/00/77; 1 page.

*Primary Examiner*—Richard E. Chilcot, Jr.

[57] ABSTRACT

Refractory ceramic fiber blanket modules with a continuous strip of ceramic fiber material folded into a number of layers in a serpentine fashion are used to insulate high temperature equipment. The blanket is supported by support structure which penetrates the blanket in the vicinity of folds near the furnace wall, providing increased strength against tearing away of the blanket from the supports.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 10 is cancelled.

Claims 1 and 4 are determined to be patentable as amended.

Claims 2, 3 and 5–9 dependent on an amended claim, are determined to be patentable.

New claims 11–22 are added and determined to be patentable.

1. Attachment hardware adapted for mounting an insulation module on one *wall* surface of a furnace, said module having a hot face and a cold face which between them define a module thickness, a pair of said faces which between them define a module length, and a top face and a bottom face which between them define a module width, said hardware comprising:

suspension arm means extending along [some] *a minor* portion of the length and width of the cold face of the module, said suspension arm means having a plurality of suspension tabs extending from the cold face toward the hot face for some predetermined distance into the thickness of said module intermediate said two side faces;

at least one set of aligned apertures in said suspension tabs;

support bar means extending longitudinally through at least some portion of the length of the module, said support bar means being received in *and supported by* said at least one set of aligned apertures in the plurality of suspension tabs and penetrating said module, said portion of the length of the module being less than the full length whereby said suspension tabs and said support bar means are fully contained internally of said module; and

*securement* means for securing said suspension arm means to said furnace wall *surface.*

4. The attachment hardware of claim 1 further comprising two *fold* support rods extending generally perpendicular to said support bar means.

*11. The attachment hardware of claim 1, wherein said suspension arm means is adapted to be located generally centrally of the module;*

*said support bar means including at least one support rod, said support rod extending axially beyond a respective one of said plurality of suspension tabs a substantial distance along the length of the module whereby the support rod is generally supported within a central portion of the module and provides support for the module substantially throughout the length of the module.*

*12. The attachment hardware of claim 1 wherein said securement means includes a single attachment point means located gerally centrally of said suspension arms means for securing said suspension arm means to said furnace wall surface.*

*13. The attachment hardware of claim 1, wherein said at least one set of aligned apertures in said suspension tabs define an axis extending longitudinally of the length of the module, said support bar means including a single support rod received within said at least one set of aligned apertures.*

*14. The attachment hardware of claim 13, wherein said axis is generally parallel of the cold face of the module.*

*15. The attachment hardware of claim 13, wherein said support rod is of uniform cross section and slidingly received within said suspension tabs, unrestrained thereby in the direction of said axis, whereby the relative position between said support bar means and said suspension arm means may be readily established within the module during initial assembly of the module and attachment hardware.*

*16. The attachment hardware of claim 15, wherein said axis is generally parallel of the cold face of the module.*

*17. The attachment hardware of claim 16, wherein said securement means includes a single attachment point means located generally centrally of said suspension arms means for securing said suspension arm means to said furnace wall surface.*

*18. The attachment hardware of claim 17, wherein said suspension arm means includes a generally flat plate member extending between said suspension tabs and adapted to be disposed flat to the cold face of the module, said single point attachment means including an aperture located within said flat plate member intermediate said suspension tabs whereby said suspension arm means may be secured to said furnace wall surface by a single bolt or other such mounting device.*

*19. The attachment of claim 18, wherein said suspension tabs are separate members which are affixed to the suspension arm means.*

*20. The attachment hardware of claim 1, wherein said plurality of suspension tabs includes a pair of suspension tabs located across the module width, one each of said apertures being located in each suspension tab of said pair of suspension tabs and defining an axis, said support bar means including a pair of support rods with one each of said support rods being received within a respective one of said apertures whereby the module is supported by said support rods substantially uniformly across the module length and at spaced locations across the module width.*

*21. The attachment hardware of claim 20, wherein said securement means is located generally centrally of said pair of suspension tabs.*

*22. The attachment hardware of claim 21, wherein said axis is generally parallel of the cold face of the module; and*

*said support rods being of uniform cross section and slidingly received within said suspension tabs, unrestrained thereby in the direction of said axis, whereby the relative position between said support bar means and said suspension arm means may be readily established within the module during initial assembly.*

* * * * *